US007669292B2

(12) United States Patent
Chute et al.

(10) Patent No.: US 7,669,292 B2
(45) Date of Patent: Mar. 2, 2010

(54) DECORTICATION PROCESS

(76) Inventors: Wade Chute, c/o 250 Karl Clark Rd., Edmonton, AB (CA) T6N 1E4; Deb Henry, c/o 250 Karl Clark Rd., Edmonton, AB (CA) T6N 1E4; Dean Rolheiser, c/o 250 Karl Clark Rd., Edmonton, AB (CA) T6N 1E4

( * ) Notice: Subject to any disclaimer, the term of this patent is extended or adjusted under 35 U.S.C. 154(b) by 0 days.

(21) Appl. No.: 12/126,398

(22) Filed: May 23, 2008

(65) Prior Publication Data

US 2008/0289149 A1 Nov. 27, 2008

Related U.S. Application Data

(60) Provisional application No. 60/939,736, filed on May 23, 2007.

(51) Int. Cl.
*D01B 1/00* (2006.01)

(52) U.S. Cl. ..... 19/5 R; 19/24

(58) Field of Classification Search ..... 19/5 R, 19/24, 25

See application file for complete search history.

(56) References Cited

U.S. PATENT DOCUMENTS

| | | | | |
|---|---|---|---|---|
| 3,872,545 | A | 3/1975 | Altosaar | |
| 4,241,474 | A | 12/1980 | Doutre | |
| 5,437,080 | A | 8/1995 | Stummer | |
| 5,465,464 | A | 11/1995 | Chen et al. | |
| 5,466,188 | A | 11/1995 | Schaal et al. | |
| 5,507,074 | A | 4/1996 | Chen et al. | |
| 5,632,135 | A | 5/1997 | Baker, IV et al. | |
| 5,656,129 | A | 8/1997 | Good et al. | |
| 5,720,083 | A | 2/1998 | Leduc et al. | |
| 5,906,030 | A | 5/1999 | Leduc et al. | |
| 6,079,647 | A | 6/2000 | Leduc et al. | |
| 6,767,634 | B2 | 7/2004 | Krishnaswamy | |
| 7,005,034 | B1 * | 2/2006 | Moberg et al. | 162/28 |
| 7,300,541 | B2 * | 11/2007 | Sabourin | 162/28 |
| 2005/0241785 | A1 * | 11/2005 | Peng et al. | 162/72 |
| 2008/0105391 | A1 * | 5/2008 | Sabourin | 162/18 |

FOREIGN PATENT DOCUMENTS

| | | |
|---|---|---|
| CA | 295577 | 12/1929 |
| CA | 381550 | 5/1939 |
| CA | 431521 | 11/1945 |

(Continued)

OTHER PUBLICATIONS

Munder, F. et al., Results of an Advanced Technology For Decortication of Hemp, Flax and Linseed, Mol. Cryst. Liq. Cryst., 2004, pp. 165-179, vol. 418, Taylor & Francis Inc.

(Continued)

*Primary Examiner*—Shaun R Hurley
(74) *Attorney, Agent, or Firm*—Bennett Jones LLP

(57) ABSTRACT

A process of decortication for separating the bast from the inner core of fibre plants using a disc refiner includes the steps of cutting the straw to a predetermined length; refining the straw by passing the cut straw of the predetermined length through a disc refiner with an applied energy less than about 150 kWh/t; and screening the refined straw to separate the bast fibres from the inner core.

13 Claims, 2 Drawing Sheets

Decortication process flowsheet

FOREIGN PATENT DOCUMENTS

| | | |
|---|---|---|
| CA | 527681 | 7/1956 |
| CA | 531754 | 10/1956 |
| DE | 19800170 | 7/1999 |
| EP | 0744477 | 11/1996 |
| EP | 1780316 | 2/2007 |

OTHER PUBLICATIONS

Hobson, R.N. et al., Quality of Fibre Separated from Unretted Hemp Stems by Decortication, J. Agric. Engag Res., 2001, pp. 153-158, vol. 78(2), Silsoe Research Institute.

* cited by examiner

Decortication process flowsheet

DECORTICATION PROCESS

CROSS REFERENCE TO RELATED APPLICATIONS

This application claims the priority benefit of U.S. Provisional Patent Application No. 60/939,736 entitled Decortication Process filed on May 23, 2007, the contents of which are incorporated herein by reference.

FIELD OF THE INVENTION

The present invention relates to a decortication process, and in particular to a process for generating clean bast fibres from the straw of fibre crops.

BACKGROUND

Bast fibres obtained from dicotyledonous plants such as jute, hemp, flax, ramie or kenaf, have a number of commercial applications. Bast fibres have traditionally been used by the textile industry to manufacture spun products such as carpet yarn, rope, geotextile, traditional hessian and burlap. However, increasingly bast fibres are being used by other industries for such things as the manufacture of non-woven mats and carpets, composite materials, and automobile interior panels. Cellulose-based industries are also recovering cellulose from bast for use in pulp and paper production.

Before bast fibres can be used, they must be first separated from the inner core of the fibre plant by some form of decortication process. Prior art decortication processes vary but generally employ automated machinery that subjects the fibre plant to mechanical stresses that physically rupture the bond between the inner core and the bast. The machine then separates the bast from the inner core. Another process commonly employed to separate bast from the inner core is that of "retting", which is a process of submerging the plant stalks in water, and soaking them for a period of time to loosen the fibres from the other components of the stalk. Retting can also be done by letting the cut crop stand in the fields exposed to atmospheric moisture. Bacterial action attacks pectin and lignin, freeing the cellulose fibres. The stalks are then removed and washed and subjected to mechanical processing to remove the soft tissue and then dried. A process employing a combination of retting and decortication machinery may also be used to obtain bast fibres.

The textile industry requires relatively long strand lengths of bast fibres. Accordingly, use of bast fibres in the textile industry has resulted in the development of decortication processes and machines that produce a longer staple of fibre, being 50 millimeters or longer, often in excess of 150 millimeters. However, the non-textile industries such as the cellulose based industry and composite moulding industries do not require long strand lengths and in fact, often have to cut the bast fibres into shorter lengths prior to use.

The removal of the need for longer fibres has created the possibility for the development of alternative decortication processes employing equipment that produces bast fibre strands having shorter lengths.

SUMMARY OF THE INVENTION

The present invention is directed to a decortication process, and in particular to a process for generating clean bast fibres from the straw of fibre crops.

Accordingly, in one aspect of the invention, the invention comprises a method of producing bast fibres by processing the straw of a plant having a bast layer and an inner core by processing the straw within a disc refiner. In one embodiment, the method may comprise the steps of:

(a) cutting the straw to a predetermined length;

(b) refining the straw by passing the cut straw of the predetermined length through a disc refiner, at an applied energy of less than about 150 kWh/t; and (c) screening the refined straw to separate the bast fibres from the inner core.

In one embodiment, the cut straw is screened to separate any straw that is longer than the predetermined length, prior to refining.

In one embodiment, the last screening step separates the refined straw into specific fractions. The screened fractions may comprise clean bast fibres; crude bast fibres; crude inner core; and dust. The crude bast may be further screened or refined, or both, to increase purity and bast recovery. In one embodiment, the crude bast may be reprocessed with new feedstock. The crude inner core may be further screened or refined, or both, for further bast recovery and improved core purity. In one embodiment, the crude inner core may be reprocessed with new feedstock.

In one embodiment the straw is cut by feeding it through a forage chopper. In one embodiment, the length of the cut straw is less than about 50 millimeters, and may preferably be less than about 10 millimeters. In one embodiment, the cut straw is passed through a dry disc refiner at atmospheric pressure. The disc refiner may comprise at least one rotor plate.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

The present invention provides for a decortication process, and in particular to a process for generating clean bast fibres from the straw of fibre crops. The present invention uses a disc refiner for decortication on a shorter strand base. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In this patent the following words are intended to have the following meaning:

"Bast" refers to the fibres of the phloem or inner bark of a plant from a fibre crop.

"Decortication" refers to a process of separating the bast of a plant from the inner core.

"Disc refiners" are well known in the art and commonly used to change the structure of pulp and paper fibres, and refers to a machine utilizing at least two refiner plates in which one or all of the plates rotate and press on the fibres as the fibres pass between them.

"Fibre crops" refers to crops of dicotyledonous plants having bast fibres. Common fibre crops include jute, hemp, flax, ramie, kenaf, and roselle hemp.

"Includes", "include", "including" and "comprising" as used herein shall all mean "including without limitation".

"Inner core" refers to the inner fibrous core of a plant from a fibre crop which may be separated from the cortical bast fibres of the plant.

"Strands" refers to a bundle of fibres.

"Straw" refers to the stalks of plants of fibre crops.

The present invention is directed to a decortication process, and in particular to a process for generating clean bast fibres from the straw of fibre crops. The process involves the novel use of a disc refiner, a piece of equipment used in the pulp and paper industry to fiberize wood pulp and not previously known for use in the production of bast fibres.

Figure 1:
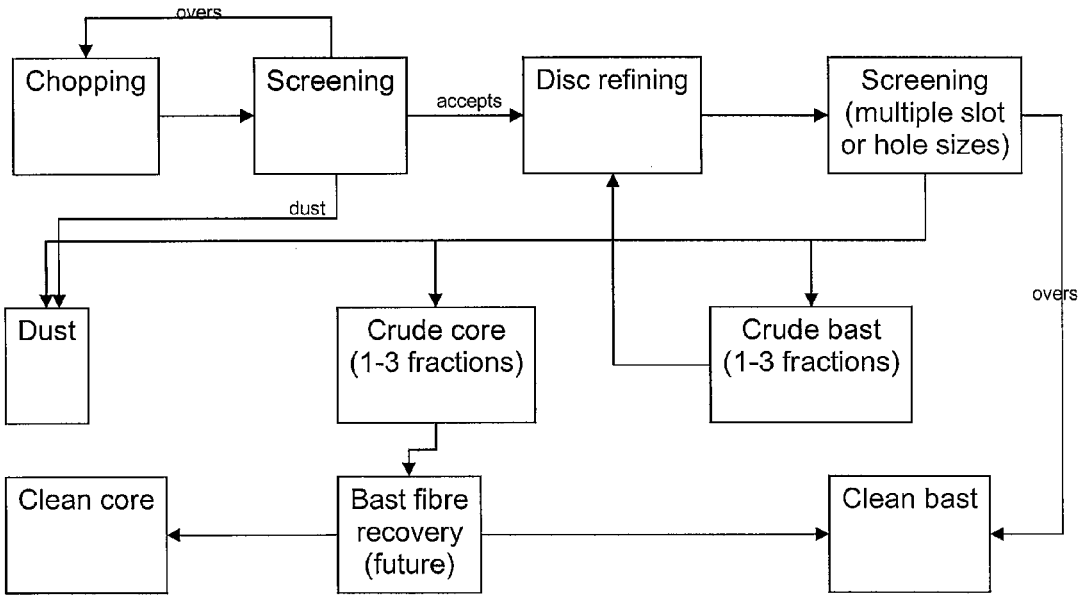
FIG. 1 is a flow chart of the process of the present invention.

FIG. 1 depicts a flow chart for the process of the present invention. The process may be summarized as a process for generating clean bast fibres from the straw of fibre crops, including hemp, flax, kenaf, and jute, having a series of process stages including:

(a) a straw chopping and screening stage to set the initial bast fibre length;

(b) a refining stage to mechanically detach bast fibres from core material; and (c) a screening stage to physically separate the detached bast fibres from the inner core material. This screening stage also allows screen accepts (i.e. material that passes through the screen) to be fractionated into market-specific categories of product.

The bast fibres produced by the present process may be cleaned and can then be treated and used in composite materials, or subsequently chemically processed into non-wood fibre pulps for various paper or cellulose-based applications.

The first step in the process is directed to the cutting of the straw to predetermined lengths. A forage chopper or any other similar cutting apparatus as would be selected by one skilled in the art is preferred for cutting the straw. A tub grinder or hammermill can also be used to cut the straw. Depending on the starting format of the raw material being used, there may be a need to open bales or break the straw into shorter lengths, or both, before feeding it into the forage chopper. The main objective of the cutting stage is to set the initial fibre length. The predetermined length is achieved by controlling ratio of cutter head speed to feed conveyor speed in the forage chopper. Fibre orientation will impact the accuracy of cut length and orienting the straw perpendicular to the cutter head is preferred, though not essential to the process. Particle lengths of 50 millimeters or less are preferred, for example, less than about 40 millimeters, 30 millimeters or 20 millimeters. Particles of 10 millimeters or less are more preferred.

In one embodiment, immediately following the cutting, the chopped material is screened to remove material that has inadvertently not been cut, or that is longer then the desired length. This screening and removal helps prevent the plugging of downstream process equipment. Uncut and long straw is re-routed back to the forage chopper for further size reduction.

The next stage in the process is the refining stage. The screened, forage chopped straw is fed into the disc refiner. The primary objective of the refining stage is to mechanically detach the bast from inner core, preferably with minimal impact on bast fibre length.

A disc refiner is typically used in the pulp and paper industry and is comprised of opposing rotating refiner plates that exert a physical force on the fibres passing between them. The material passes between the refiner plates operating at a fixed speed through a fixed gap. The shearing action of the refiner plates detaches bast fibres from the inner core particles. The present invention preferably uses a dry disc refiner operating at atmospheric pressure to avoid tangling of the fibres. A dry disc refiner is a refiner operating on feedstock that preferably has a solid content of 80% or greater, for example 90% or greater.

The grinding of the cut straw by the disc refiner is affected by the following variables: (a) feed rate of the cut straw; (b) the gap between the plates that the straw must pass through; (c) the bar pattern of the plates; (d) the power applied to the straw fibres through the plates; and (e) the moisture content of the straw fibres. One skilled in the art will be able to manipulate these variables to produce suitable results. For example, it is known a combination of these variable may produce greater than desired refining action, and may decrease pure bast fibre production, while increasing unusable dust. Alternatively, if the refining action is not enough, there may be insufficient separation of the bast fibres from the inner core material.

In one embodiment, the moisture content of the straw is preferably less than about 15%. The plate pattern varies widely between different manufacturers and some plate patterns are more aggressive than others. The feed rate may vary according to the size of the disc refiner and the rotating speed of the refiner.

In one embodiment, the process utilizes a positive plate gap, such that no overlap between complementary plate patterns exists. The minimum plate gap at the outside diameter of the disc may be about 1 mm to about 10 mm.

Disc refiners conventionally operate with applied energy greater than 250 kWh/t of material. To the inventors knowledge, the lowest applied energy case is the use of high consistency disc refiners in the process of making medium-density fibreboard, which is in the order of 250 kWh/t to about 300 kWh/t. In the present invention, much lower refining energies are required. Therefore, in one embodiment, the applied energy of the disc refiner is between about 10 kWh/t to about 150 kWh/t, preferably between about 10 kWh/t to about 100 kWh/t, and most preferably between about 20 kWh/t to 80 kWh/t. In one exemplary embodiment, the applied energy is about 50 kWh/t.

Figure 2:
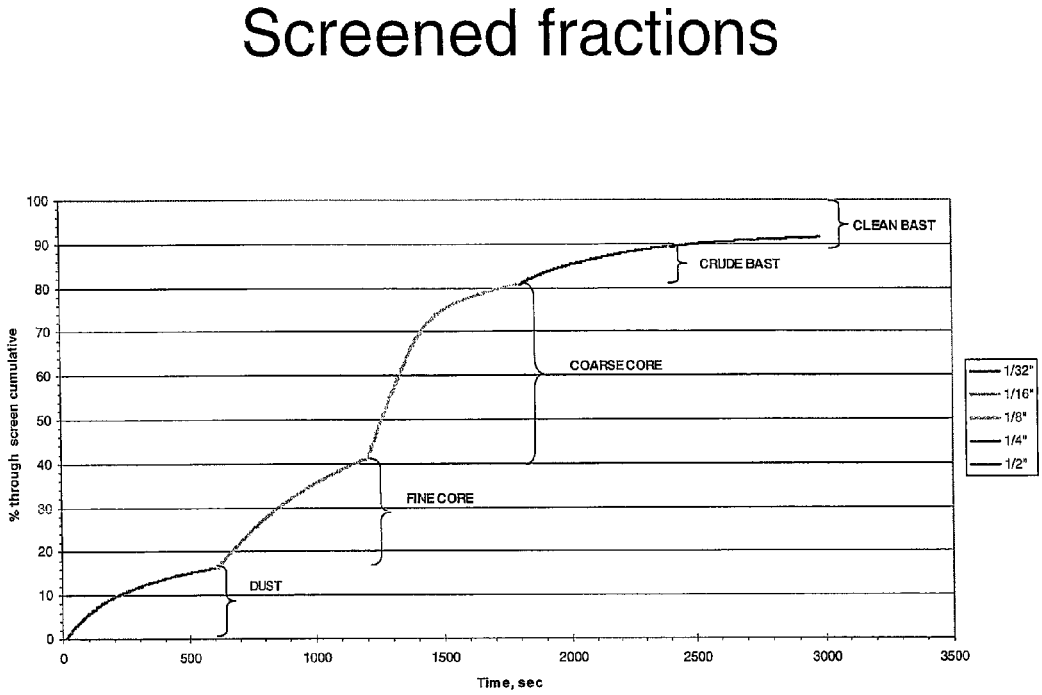
FIG. 2 is a graphical depiction of the screened fractions.

Following the refining stage, the refined straw immediately undergoes a further screening step which separates the refined product into various fractions. FIG. 2 shows a graphical depiction of the screen fractions. The stream fractions are as follows:

(a) Clean bast;

(b) Crude bast (1-3 streams). The crude bast may be re-refined and re-screened to increase purity;

(c) Crude inner core (1-3 streams). The crude inner core may be further mechanically separated (screening or air separation) for increased bast recovery; and (d) Dust.

The fractions may be used for various primary commercial products. Clean bast fibres can be used for cellulose and composite markets. Clean core fibres may be used for the food, chemical, board, absorbent or polymer markets. The dust may be used for the energy or composite markets (wood flour equivalent).

For both screening steps in the process of the present invention, the screen used can be any suitable screen as would be selected by one skilled in the art including a vibrating screen, a rotary/trommel screen or a roll screen.

As will be apparent to those skilled in the art, various modifications, adaptations and variations of the foregoing specific disclosure can be made without departing from the scope of the invention claimed herein.

What is claimed is:

1. A method of producing bast fibres by processing the straw of a plant having a bast layer and an inner core, said method comprising the steps of:

a. cutting the straw to a predetermined length;

b. refining the straw by passing the cut straw of the predetermined length through a disc refiner with an applied energy less than about 150 kWh/t; and c. screening the refined straw to separate the refined straw into specific fractions comprising clean bast fibres, crude bast fibres, crude inner core, and dust.

2. The method of claim 1 further comprising the step of screening the cut straw to separate any straw that is longer than the predetermined length, prior to refining the straw.

3. The method of claim 1 further comprising screening or refining, or both screening and refining, of the crude bast fibres to increase purity.

4. The method of claim 1 further comprising screening or refining, or both screening and refining, of the crude inner core for further recovery of clean bast fibres or clean inner core.

5. The method of claim 1 wherein the straw is cut by feeding it through a forage chopper.

6. The method of claim 1 wherein the length of the cut straw is less than 50 millimeters.

7. The method of claim 1 wherein the length of the cut straw is less than 10 millimeters.

8. The method of claim 1 wherein the cut straw is passed through a dry disc refiner at atmospheric pressure.

9. The method of claim 1 wherein the disc refiner comprises at least one stator plate and at least one rotor plate.

10. The method of claim 1 wherein the disc refiner comprises at least one rotor plate.

11. A method of producing bast fibres by processing the straw of a plant having a bast layer and an inner core, said method comprising the steps of:

a. cutting the straw to a predetermined length;

b. dry refining the straw by passing the cut straw of the predetermined length through a disc refiner with an applied energy less than about 150 kWh/t; and c. screening the refined straw to separate the bast fibres from the inner core.

12. The method of claim 11 wherein the straw has a moisture content of 15% or less.

13. The method of claim 12 wherein the last screening step separates the refined straw into specific fractions comprising clean bast fibres, crude bast fibres, crude inner core, and dust.

* * * * *